US008739543B2

(12) United States Patent
Deuker et al.

(10) Patent No.: US 8,739,543 B2
(45) Date of Patent: Jun. 3, 2014

(54) BURNER AND METHOD FOR OPERATING A BURNER

(75) Inventors: Eberhard Deuker, Mülheim an der Ruhr (DE); Anil Gulati, Winter Springs, FL (US); Andreas Heilos, Mülheim an der Ruhr (DE)

(73) Assignee: Siemens Aktiengesellschaft, München (DE)

( * ) Notice: Subject to any disclaimer, the term of this patent is extended or adjusted under 35 U.S.C. 154(b) by 1042 days.

(21) Appl. No.: 12/665,049

(22) PCT Filed: Jan. 18, 2008

(86) PCT No.: PCT/EP2008/050550

§ 371 (c)(1),
(2), (4) Date: Dec. 17, 2009

(87) PCT Pub. No.: WO2009/003729

PCT Pub. Date: Jan. 8, 2009

(65) Prior Publication Data

US 2010/0180598 A1 Jul. 22, 2010

(30) Foreign Application Priority Data

Jul. 2, 2007 (DE) ..... 10 2007 030 766

(51) Int. Cl.
*F02C 9/26* (2006.01)

(52) U.S. Cl.
USPC ..... 60/733; 60/734; 60/739; 60/740; 60/742; 60/746; 60/747; 431/12; 431/18; 431/62

(58) Field of Classification Search
USPC ..... 60/733, 734, 737, 738, 739, 740, 742, 60/746, 747; 431/8, 12, 18, 62, 72, 89, 431/171, 181, 186
See application file for complete search history.

(56) References Cited

U.S. PATENT DOCUMENTS

| | | | | |
|---|---|---|---|---|
| 5,235,814 A | | 8/1993 | Leonard | |
| 5,361,586 A | * | 11/1994 | McWhirter et al. | 60/737 |
| 5,490,380 A | * | 2/1996 | Marshall | 60/776 |
| 5,491,970 A | | 2/1996 | Davis, Jr. et al. | |

(Continued)

FOREIGN PATENT DOCUMENTS

| | | |
|---|---|---|
| CN | 1242201 C | 2/2006 |
| EP | 0691511 A1 | 1/1996 |

(Continued)

OTHER PUBLICATIONS

Communication from Yamaguchi International Patent Office, Aug. 17, 2011, pp. 1-2, 1-5.

*Primary Examiner* — Phutthiwat Wongwian
*Assistant Examiner* — Steven Sutherland

(57) ABSTRACT

A method for operating a burner including a burner outlet opening with at least two sectors, each sector is assigned at least one fuel nozzle, is provided. The method is characterized in that fuel is supplied separately to the fuel nozzles of different sectors. Also described is a burner which includes at least two sectors wherein each sector is assigned at least one fuel nozzle. The burner includes at least two separate fuel supply lines and a device for adjusting the fuel mass flow which flows through the respective fuel supply line. The fuel supply lines supply fuel to the fuel nozzles of different sectors. Also described is a gas turbine which is fitted with at least one burner.

20 Claims, 6 Drawing Sheets

(56) References Cited

U.S. PATENT DOCUMENTS

| | | | | |
|---|---|---|---|---|
| 6,109,038 | A | 8/2000 | Sharifi | |
| 6,513,334 | B2 | 2/2003 | Varney | |
| 6,945,053 | B2 | 9/2005 | Von Der Bank | |
| 6,962,055 | B2 * | 11/2005 | Chen et al. | 60/746 |
| 7,024,862 | B2 * | 4/2006 | Miyake et al. | 60/773 |
| 2004/0226300 | A1 | 11/2004 | Stuttaford et al. | |
| 2006/0101814 | A1 * | 5/2006 | Saitoh et al. | 60/377 |
| 2008/0083841 | A1 | 4/2008 | Bainville et al. | |

FOREIGN PATENT DOCUMENTS

| | | | |
|---|---|---|---|
| EP | 1180646 | A1 | 2/2002 |
| EP | 1319895 | A2 | 6/2003 |
| EP | 1909031 | A1 | 4/2008 |
| JP | 6213452 | A | 8/1994 |
| JP | 07190370 | A | 7/1995 |
| JP | 2004003752 | A | 1/2004 |
| JP | 2006336995 | A | 12/2006 |
| SU | 978658 | A1 | 10/1991 |

* cited by examiner

BURNER AND METHOD FOR OPERATING A BURNER

CROSS REFERENCE TO RELATED APPLICATIONS

This application is the US National Stage of International Application No. PCT/EP2008/050550, filed Jan. 18, 2008 and claims the benefit thereof. The International Application claims the benefits of German application No. 10 2007 030 766.9 DE filed Jul. 2, 2007, both of the applications are incorporated by reference herein in their entirety.

FIELD OF INVENTION

The following invention relates to a method for operating a burner, a burner and a gas turbine with reduced CO and $NO_x$ emissions.

BACKGROUND OF INVENTION

A major requirement of modern burners, especially of burners used as part of a gas turbine, is to cover a greatest possible power range with the lowest emissions possible. The undesired emissions concerned are in particular carbon monoxide emissions (CO emissions) and nitric oxide emissions ($NO_x$ emissions). Basically the power of a burner is almost proportional to the flame temperature and to the air mass flow. Operation at low power means a low flame temperature, whereby CO emissions increase markedly. In addition the flame also becomes longer in such cases, which with cooled burner walls leads to quench effects, also resulting in increased CO emissions.

With a gas turbine the result can also be thermo acoustic instability over the entire operating range, which can jeopardize safe operation of the combustion system. Such thermo acoustic instability is frequently also referred to as "vibration" and can occur especially with the premix burners currently generally used.

As a rule the burners of a gas turbine must be switched off below a critical temperature limit at which the flame becomes unstable or the CO emissions become too high. If necessary other burner stages must be operated, as a rule diffusion burners, which however then create high $NO_x$ emissions.

SUMMARY OF INVENTION

An object of the present invention is to provide an advantageous method for operating a burner. Further objects of the invention consist of providing an advantageous burner and an advantageous gas turbine.

These objects are achieved by a method as claimed in the claims, a burner as claimed in the claims and a gas turbine as claimed in the claims. The independent claims contain further advantageous embodiments of the invention.

The inventive method relates to a burner comprising a burner output opening with at least two sectors, with each sector being assigned at least one fuel nozzle. The fuel nozzles of different sectors are supplied separately with fuel. This method of operating a burner is especially suitable for the operation of a gas turbine burner. The separate supply of fuel to the fuel nozzles of different sectors can be controlled with aid of valves for example.

The inventive method enables the a reduction of the CO and/or $NO_x$ emissions to be achieved in part-load operation of the burner. For example fuel can be supplied to the fuel nozzles of different sectors of the fuel outlet opening in an adjustable ratio of between 0:100 and 100:0, especially between 0:100 and 35:65.

Usually the burner is arranged in a combustion chamber. In such cases the combustion chamber has a central axis. The burner also has a radial direction and a tangential direction in relation to the central axis of the combustion chamber. The radial direction of the burner is characterized here in that it intersects with the central axis of the combustion chamber. The tangential direction of the burner is at right angles to the radial direction of the burner and runs tangentially to an imaginary circle applied around the central axis of the combustion chamber.

It has proved advantageous for the fuel nozzles which are assigned to a sector which is arranged along the tangential direction of the burner to be supplied with less fuel than the fuel nozzles which are assigned to a sector which is arranged along the radial direction of the burner. For example the fuel nozzles which are assigned to a sector which is arranged along the tangential direction of the burner can be supplied with 20% of the overall amount of fuel supplied to the burner. The fuel nozzles which are assigned to a sector which is arranged along the radial direction of the burner will be supplied in this case with 80% of the overall amount of fuel supplied to the burner.

It is known that separate control of the fuel supply to the individual sectors of the burner, typically with valves able to be regulated separately, will produce hotter and colder zones in the combustion chamber in part-load operation. Less carbon monoxide is produced in the hotter zones. The hotter zones can especially also be placed in those areas where the greatest quench effect would otherwise be expected. The colder zones can be placed where the longest time is available for full combustion so that here, despite a cooler temperature, no additional carbon monoxide or only insignificantly more carbon monoxide is produced. Overall, the total CO emissions generated are reduced with the total amount of fuel and thereby also the total power remaining the same.

In marginal cases individual sectors can also be switched off entirely, whereby no carbon monoxide can be produced in these sectors, since no fuel is present. During this time the other sectors are so hot that they barely produce any carbon monoxide. However there will always also be a transitional layer in this case between a hot and a cold zone in which CO emissions arise.

The modified temperature field produced by using the inventive method and the simultaneously modified time needed by the fuel to travel from the nozzle outlet to the flame front also influences the thermo acoustic behavior of the combustion chamber used. The separate supply of fuel to the sectors can thus also be used to explicitly exert a positive influence on the thermo acoustic behavior.

In full-load operation the aim as a rule is to achieve a homogeneous temperature distribution, since this means the least stress on components and the lowest $NO_x$ emissions. All sectors are again preferably supplied evenly with fuel here.

The inventive burner comprises a burner outlet opening with at least two sectors, with each sector being assigned at least one fuel nozzle. The inventive burner is characterized by having at least two separate fuel supply lines leading to the fuel nozzles of different sectors and a facility for setting the fuel mass flow passing through the respective fuel supply line. Each fuel supply line thus supplies the fuel nozzles of other sectors with fuel.

The burner outlet opening can in particular have a circular cross-sectional surface. The fuel nozzles of the inventive burner can then be arranged for example in the form of a ring in relation to the central point of the burner outlet opening. In addition fuel nozzles lying opposite each other in each case can be assigned to the same fuel supply line. Furthermore the different sectors can form segments of the circular surface of the burner outlet opening with angles of between 70° and 110°. If for example four equal-size segments are present, these each have an angle of 90°. The fuel nozzles of segments lying opposite one another can then especially also be assigned the same fuel supply line.

Basically the facility for adjusting the fuel flowing through the respective fuel line can involve valves able to be regulated arranged in the respective fuel line.

The inventive method can be carried out with the inventive burner so that the advantages described in relation to the inventive method can be achieved.

The inventive gas turbine comprises at least one inventive burner.

Overall the present invention makes it possible to adhere to predetermined emission limits over a wide operational range. In addition a thermo acoustically stable operation of the burner over a wide operational range is possible or, with the operational range remaining the same, operation with reduced $NO_x$ emissions. The effect of the invention is thus to produce an overall expansion of the operational range of a burner. Over and above this the invention opens up expanded regulation options for operation of a burner by creating an additional measure of freedom in distribution of the fuel. Thus for example, with the overall amount of fuel remaining the same, the fuel proportion of the additional operating stage can be used as an manipulated variable in a closed-loop control circuit for regulating the thereto acoustic behavior or the emissions.

BRIEF DESCRIPTION OF THE DRAWINGS

Further features, characteristics and advantages of the present invention will be described below on the basis of exemplary embodiments which refer to the enclosed figures.

DETAILED DESCRIPTION OF INVENTION

Figure 1:
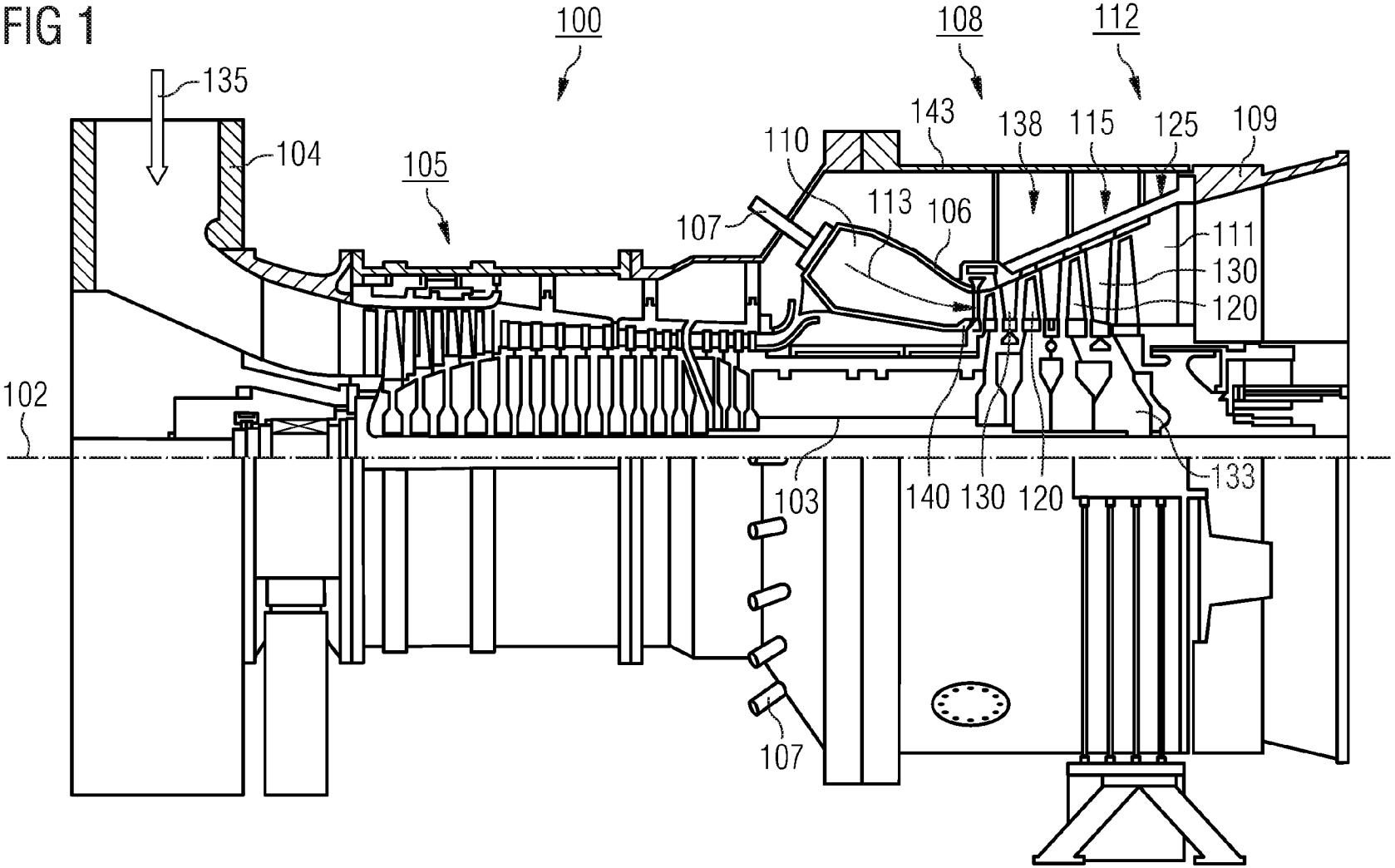
FIG. 1 shows a schematic diagram of a gas turbine in a longitudinal part section.

FIG. 1 shows an example of a gas turbine 100 in a longitudinal part section.

The gas turbine 100 features a rotor 103 inside in supported to allow its rotation around an axis of rotation 102 with a shaft, which is also referred to as the turbine rotor.

Following each other along the rotor 103 are an induction housing 104, a compressor 105, a typically toroidal combustion chamber 110, especially an annular combustion chamber, with a number of coaxially arranged burners 107, a turbine 108 and the exhaust housing 109.

The annular combustion chamber 110 communicates with a typically annular hot gas duct 111. In this duct four turbine stages 112 connected one behind the other form the turbine 108 for example.

Each turbine stage 112 is formed from two rings of blades. In the hot gas duct 111, seen in the flow direction of a working medium 113, a series of guide blades 115 is followed by a series 125 composed of rotor blades 120.

The guide blades 130 are attached in this case to an inner housing 138 of a stator 143, whereas the rotor blades 120 of a series 125 are attached for example by means of a turbine disk 133 to the rotor 103.

Coupled to the rotor 103 is a generator or work machine (not shown).

During the operation of the gas turbine 100 air 135 is sucked by the compressor 105 through the induction housing 104 and compressed. The compressed air provided at the turbine-side end of the compressor 105 is directed to the burners 107 and mixed there with a combustion agent. The mixture is burned to form a working medium 113 in the combustion chamber 110. From there the working medium 113 flows along the hot gas duct 111 past the guide blades 130 and the rotor blades 120. At the rotor blades 120 the working medium 113 expands and imparts a pulse so that the rotor blades 120 drive the rotor 103 and this drives the working machine coupled to it.

The components subjected to the hot working medium 113 are subject to thermal stresses during the operation of the gas turbine 100. The guide blades 130 and rotor blades 120 of the first turbine stage seen in the direction of flow of the working medium 113 are subject to the greatest thermal stress, along with the heat shield elements 106 cladding the annular combustion chamber 110. In order to withstand the temperatures prevailing there, these can be cooled by means of a coolant.

Figure 2:
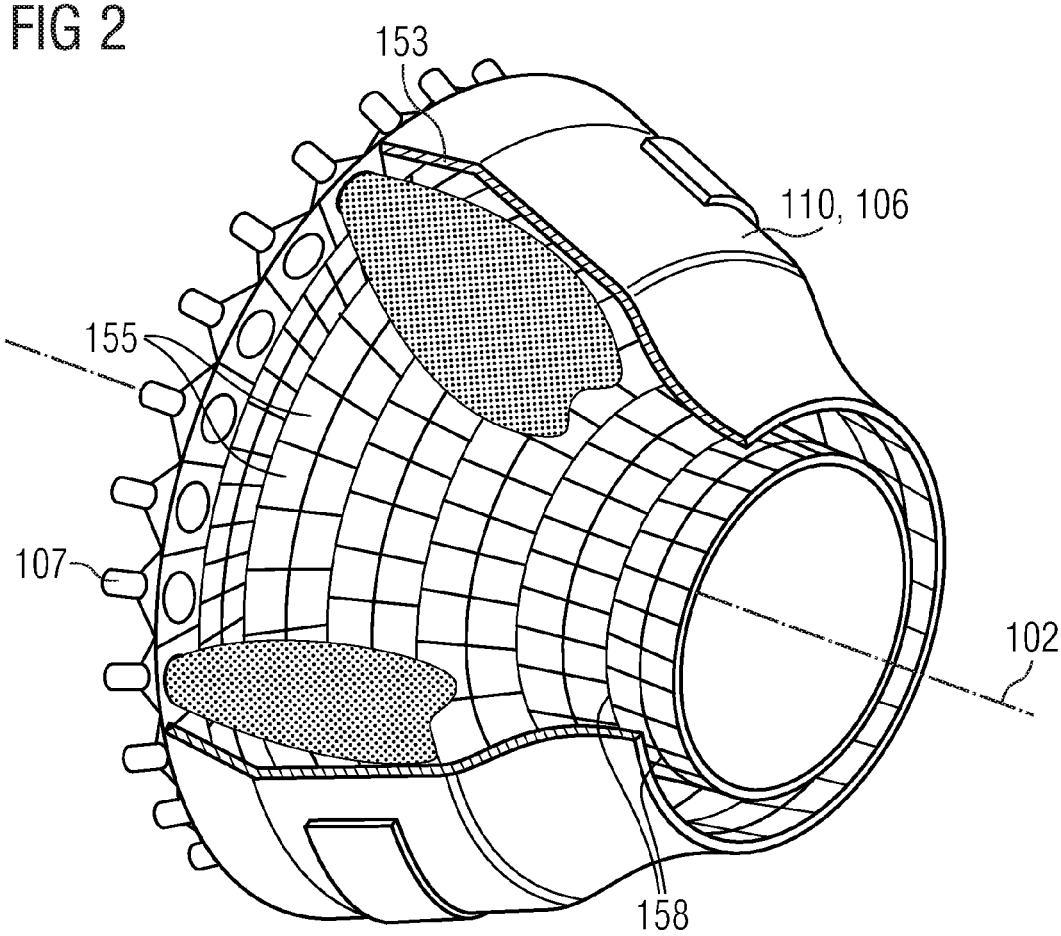
FIG. 2 shows a schematic diagram of a combustion chamber of a gas turbine in a perspective view.

FIG. 2 shows the combustion chamber 110 of the gas turbine.

The combustion chamber 110 is typically embodied as a so-called annular combustion chamber, in which a plurality of burners 107 which generate flames are arranged in a circumferential direction around an axis of rotation 102 and open out into a common combustion chamber space. To this end the combustion chamber 110 is designed overall as an annular structure which is positioned around the axis of rotation 102.

To achieve a comparatively high level of efficiency the combustion chamber 110 is designed for a comparatively high temperature of the working medium M of around 1000° C. to 1600° C. In order, even with these operating parameters unfavorable for the materials, to make a long operational life possible, the combustion chamber wall 153 is provided on its side facing towards the working medium M with an inner cladding formed from heat shield elements 155.

Figure 3:
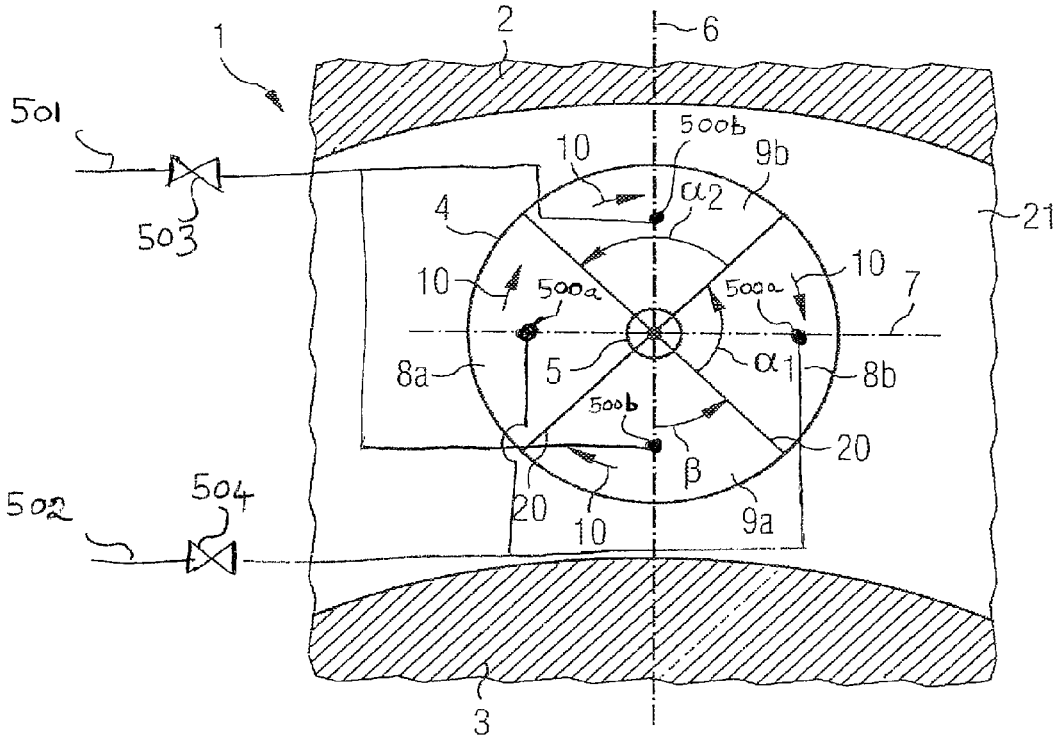
FIG. 3 shows a schematic diagram of section through a part of an annular combustion chamber.

FIG. 3 shows a section through a part of an inventive annular combustion chamber 1 with an end face wall 21, an outer wall 2 and an inner wall 3. Both the outer wall 2 and also the inner wall 3 are cooled. The danger thus arises of so-called quench effects occurring during operation of the combustion chamber. The burners 107 are arranged in the end face wall 21 of the annular combustion chamber 1. In FIG. 3 the burner outlet 4 or the burner outlet opening of one of these burners 107 can be seen in an overhead view. The burner outlet 4 has a circular cross-sectional surface. The direction of flow of the hot gas 5 runs in the example shown here at right angles out of the plane of the drawing.

The burner 107 depicted in FIG. 3 involves a premix burner in which, prior to combustion, the fuel has been swirled with air into a fuel-air mixture using a swirl generator. The direction of the swirl formed in this case is indicated in FIG. 3 by arrows 10. The inventive burner 107 depicted in FIG. 3 comprises four sectors 8*a*, 8*b* and 9*a*, 9*b*. These sectors represent segments of the cross sectional surface of the burner outlet 4, with each segment making up a quarter of the cross-sectional surface Sectors 8*a* and 8*b* or 9*a* and 9*b* lie opposite one another respectively.

In the example shown in FIG. 3 the sectors 9*a* and 9*b* lying opposite one another are arranged along the radial direction 6. Sectors 9*a* and 9*b* are thus located in the vicinity of the outer wall 2 or of the inner wall 3 respectively. The two sectors 8*a* and 8*b* are arranged along the tangential direction 7. Both the two sectors 8*a* and 8*b* and also the two sectors 9*a* and 9*b* represent a quarter circle in each case.

With reference to a longitudinal axis through the annular combustion chamber 1 not shown in FIG. 3 there is a radial direction 6 intersecting the longitudinal axis 6 and at right angles to this longitudinal axis running through the center point of the combustion chamber outlet 4. A tangential direction 7 runs at right angles to this radial direction 6 through the center point of the combustion chamber outlet 4.

In FIG. 3 the sectors 8*a*, 8*b* and 9*a*, 9*b* of the burner 107 are arranged so that one of the boundaries 20 between the sectors 8*a*, 8*b* and 9*a*, 9*b* is arranged rotated in relation to the radial direction 6 by an angle $\beta$=45° around the center point of the burner outlet 4. In addition the sectors 8 and 9 are arranged in this case rotated by an angle $\alpha$1=$\alpha$2=90° in relation to each other. In this case the angle al identifies the proportion of the cross sectional surface of the burner outlet 4 that will be covered by one of the two part areas assigned to the sector 8. The angle $\alpha$2 identifies the proportion of the cross sectional surface of the burner outlet 4 that will be covered by one of the two part areas assigned to the sector 9. As an alternative to the example depicted in FIG. 3, the angles $\alpha$1 and $\alpha$2 can also have any other values, for example 360°/n, if n sectors of equal size are to be present. The sectors can however also form segments of the cross-sectional surface of the burner outlet opening of different size. In this case it would be $\alpha \neq \alpha_2$. It is advantageous for the angles to lie between 70° and 110°.

The burner 107, of which the burner outlet 4 is depicted in FIG. 3, comprises a number of fuel nozzles 500*a* and 500*b*. The fuel nozzles 500*a*, and 500*b* are preferably arranged in the shape of a ring in relation to the center point of the burner outlet opening 4, with each sector 8*a*, 8*b*, 9*a*, 9*b* being assigned at least one fuel nozzle. Furthermore the burner 107 features two separate fuel supply lines 501 and 502, of which one(namely 502) supplies the fuel nozzles 500*a* of sectors 8*a* and 8*b* with fuel while the other (namely 501) supplies the fuel nozzles 500*b* of sectors 9*a* and 9*b* with fuel. Each fuel supply line is equipped with a facility for adjusting the fuel flowing through the respective fuel supply line. This facility preferably involves a respective valve 503, 504 that is able to be regulated.

For each output level an optimum fuel ratio can be set between the sectors 8*a* and 8*b* on the one hand and the sectors 9*a* and 9*b* on the other hand, which brings about a greatest possible reduction in the quench effect. In full-load operation the aim is to have an even supply of fuel to sectors 8*a*, 8*b* and 9*a*, 9*b*. With sectors of equal size this corresponds to a distribution of the fuel in the ratio of 50:50 to sectors 8*a* and 8*b* on the one hand and sectors 9*a* and 9*b* on the other hand.

In part-load operation the total amount of fuel supplied is reduced compared to full-load operation, which can, as mentioned above, lead to higher emissions and reduced thermo acoustic stability. A slight shift in the ratio in the distribution of the fuel to the sectors 8*a*, 8*b* and 9*a*, 9*b* can have a positive effect on the thermo acoustic stability of the burner 107 in part-load operation and also already have a positive effect on the emissions.

Basically a number of burners or all burners 107 of the annular combustion chamber 1 can be embodied according to the invention, i.e. comprise a number of sectors with separate fuel supply lines.

Figure 4:
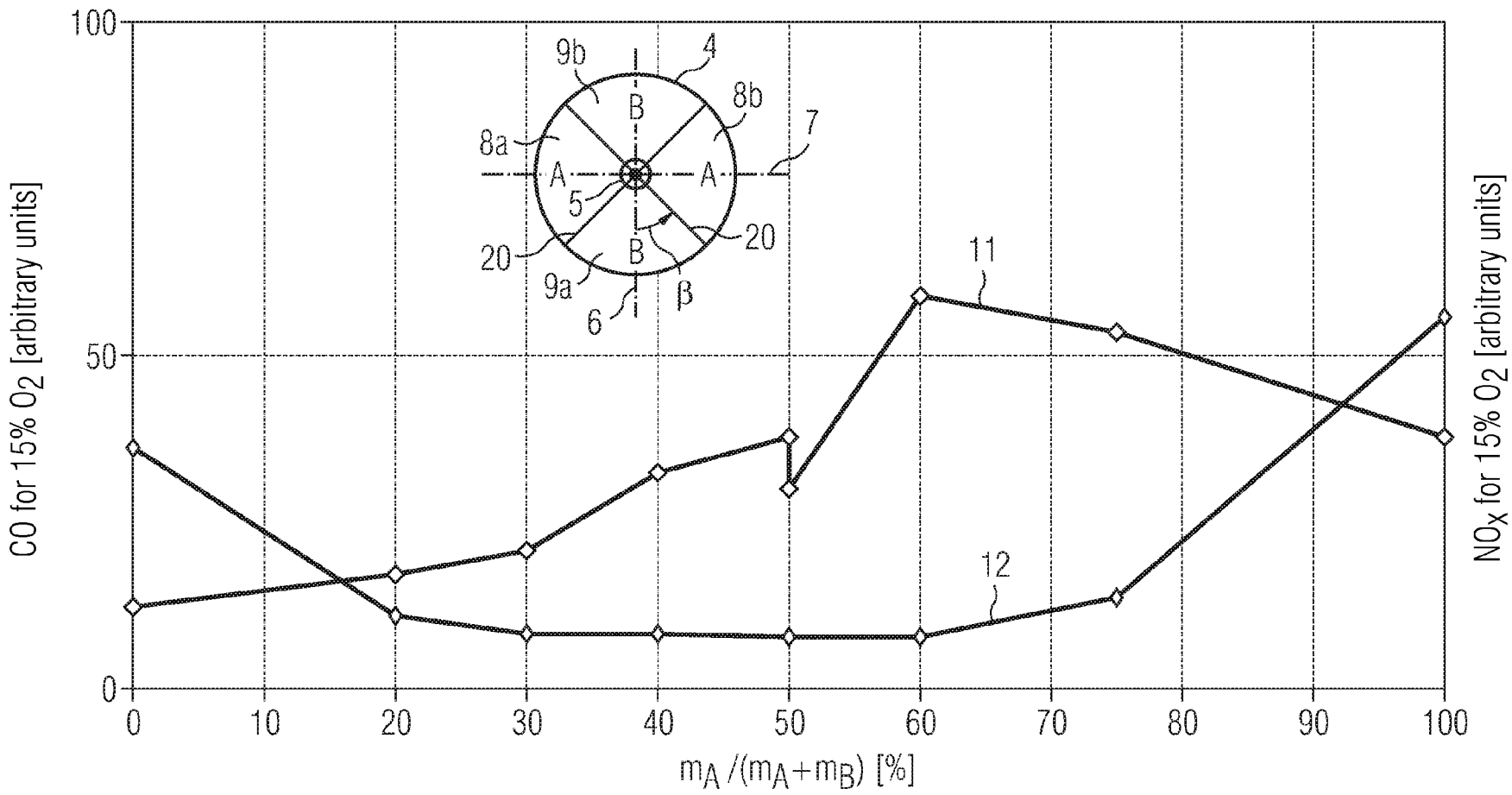
FIG. 4 shows the CO emissions and the $NO_x$ emissions of an inventive burner at various stages of operation.

FIG. 4 shows the carbon monoxide emissions and the nitric oxide emissions as a function of the ratio of the fuel supply to the individual sectors from FIG. 3. Initially shown in the center of FIG. 4 is the arrangement of the sectors of the investigated burner 107 in relation to the radial direction 6. The investigated burner 107 has a burner outlet 4 with a circular cross-sectional surface which is divided up into four sectors 8*a*, 8*b*, 9*a*, 9*b*, as has already been described in conjunction with FIG. 3. The sectors 8*a* and 8*b* are labeled A and arranged along the tangential direction 7. The sectors 9*a* and 9*b* are labeled B and arranged along the radial direction 6. The sector boundaries 20 are arranged in relation to the radial direction 6 as in FIG. 3. The sectors labeled A and B are assigned separate fuel supply lines.

On the X axis of the diagram shown in FIG. 4 the fuel mass flow $m_A$ supplied to the sectors A is proportional to the overall fuel mass flow supplied to the burner 107, i.e. the sum of the fuel mass flows supplied to the A and B ($m_A$+$m_B$), is plotted as a percentage. As a function of this the curve 11 shows the CO emissions for a proportion of 15% oxygen in the fuel-air mixture used. The CO emissions are plotted in this case in arbitrary units. The curve 11 shows that the CO emissions are at their lowest when only sectors B are supplied with fuel. Where fuel is also supplied to sectors A, the CO emissions occurring increase continuously up to a maximum. The CO emissions reach their maximum when around 60% of the fuel mass flow supplied to the burner 107 is supplied to sectors A. If sectors A are supplied with more than 60% of the total fuel mass flow supplied to the burner 107, the CO emissions occurring do in fact fall back again slightly, but they do not fall below the value achieved for an even fuel mass flow distribution to the sectors A and B.

Curve 12 shows the $NO_x$ emissions of the burner 107 for an oxygen content of 15% within the fuel-air mixture as a function of the distribution of the fuel to the sectors A and B. The units for the $NO_x$ emissions are again selected arbitrarily. Curve 12 has a dished shape. The nitric oxide emissions are accordingly minimal when the proportion of fuel supplied to the sectors A lies at around 30% and 60% of the overall fuel supplied to the burner 107. Below 30% and above 60% the nitric oxide emissions occurring increase continuously, with the maximum of nitric oxide emissions being reached when fuel is being supplied exclusively to the sectors A.

When both the carbon monoxide and also the nitric oxide emissions are to be minimized, it emerges from curves 11 and 12 in FIG. 4 that the proportion of fuel supplied to the sectors A should amount to somewhere between 15% and 30% of the overall fuel supplied to the burner 107.

Figure 5:
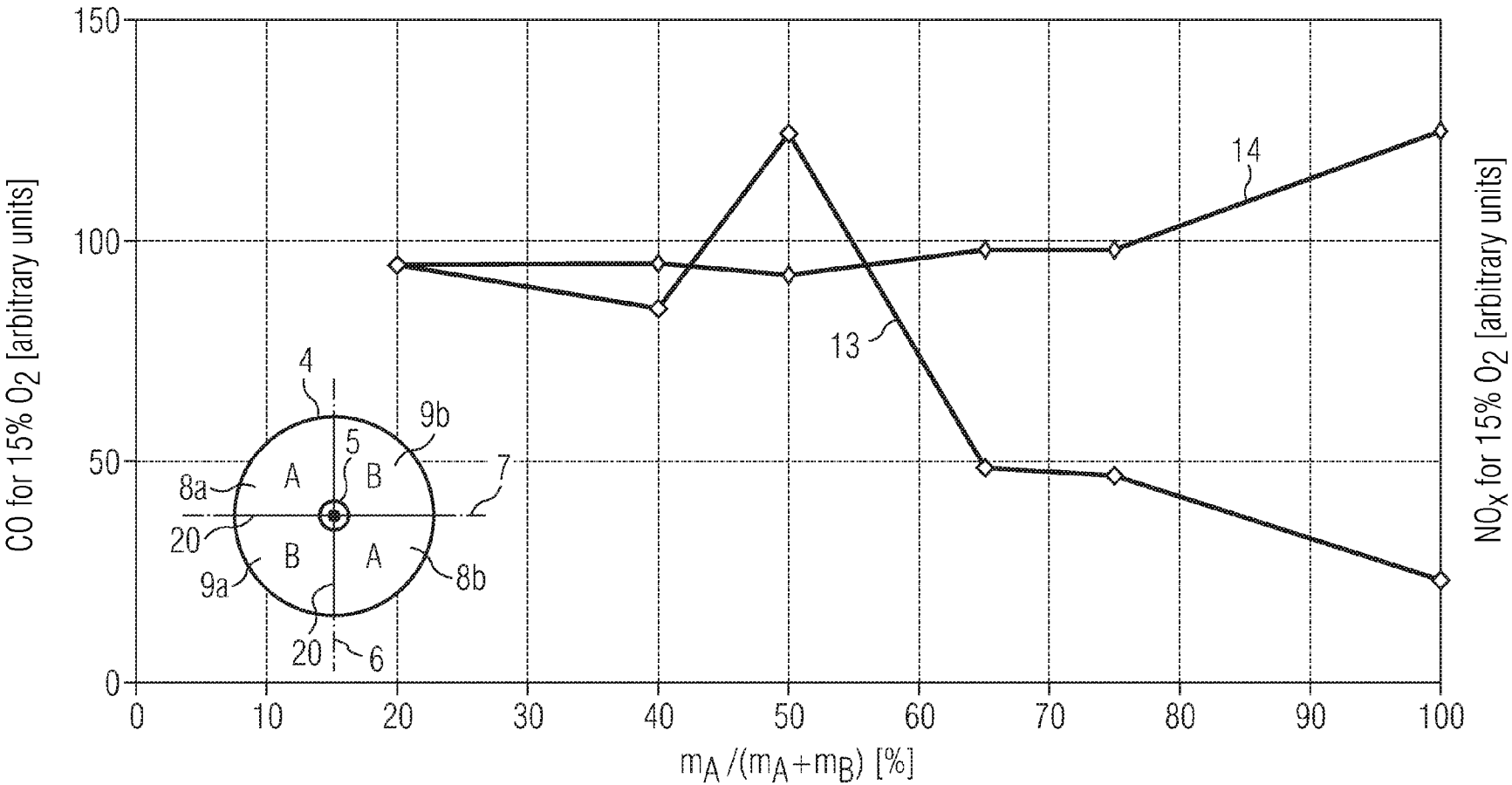
FIG. 5 shows the CO emissions and the $NO_x$ emissions of an alternate inventive burner at various stages of operation.

FIG. 5 shows the carbon monoxide emissions and the nitric oxide emissions as a function of the distribution of the fuel to the sectors A and B for an alternate arrangement of the sectors A and B. Outlined in FIG. 5 at the bottom left is the observed distribution of the sectors A and B in relation to the radial direction 6 and the tangential direction 7. It can be seen here that the boundaries 20 between the sectors A and B run in parallel to the radial direction 6 or in parallel to the tangential direction 7 respectively. This corresponds to an angle $\beta$ of 0°. This means that the sectors A or B respectively can be viewed in relation to their spacing from the outer wall 2 or to the inner wall 3 respectively as equal in value.

Plotted as a percentage on the X axis of the diagram shown in FIG. 5 is once again the proportion of the fuel mass flow $m_A$ supplied to the sectors A as a ratio of the overall fuel mass flow ($m_A$+$m_B$) supplied to the burner 107. Shown as a function of this in curve 13 in arbitrary units are the CO emissions occurring and in curve 14 the $NO_x$ emissions occurring with an oxygen proportion of 15% in the fuel-air mixture used in each case. It can be seen from curve 13 that the carbon monoxide emissions are at their lowest when all of the fuel is supplied to sector A. However in this case the nitric oxide emissions reach their maximum, as can be seen from curve 14. Overall curves 13, 14 show that a dependence of the carbon monoxide and nitric oxide emissions occurring on the distribution of the fuel to the different sectors A and B also exists in the arrangement of sectors A and B outlined in FIG. 5 and that by a suitable distribution of the fuel mass flow to the sectors A and B influence can be exerted on the emissions.

Figure 6:
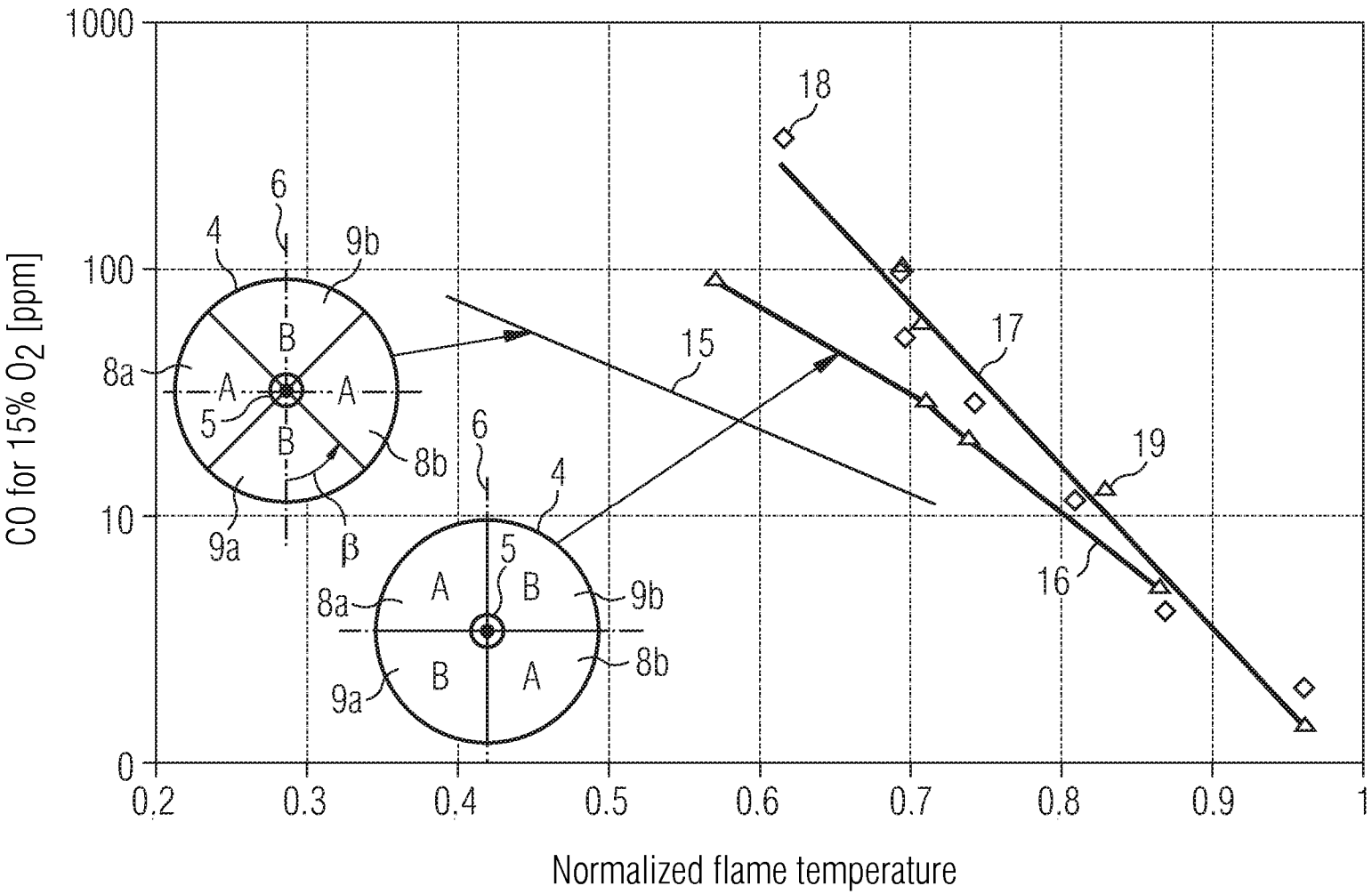
FIG. 6 shows the CO emissions as a function of the flame temperature for different burners.

FIG. 6 shows the dependence of the carbon monoxide emissions on the standardized flame temperature for a conventional burner, an inventive burner operated as a conventional burner, i.e. an inventive burner that is operated with a fuel distribution ratio of 50:50 to the sectors A and B; an inventive burner with the sector arrangement described in conjunction with FIG. 4; and also an inventive burner with the sector arrangement described in conjunction with FIG. 5. The standardized flame temperature is plotted on the X axis. Plotted in ppm (parts per million) on the Y axis are the CO emissions occurring in this case with a proportion of 15% oxygen in the fuel-air mixture used.

Curve 15 shows the dependence of the carbon monoxide emissions on the flame temperature for an inventive burner, in which the individual sectors are arranged as described in conjunction with FIGS. 3 and 4, with the fuel being supplied exclusively to the sectors B. Curve 16 shows this dependence for an inventive burner, in which the individual sectors are arranged as described in conjunction with FIG. 5, with the fuel being supplied exclusively to the sectors A.

The measurement points indicated in FIG. 6 by the triangles 19 correspond to the values which are measured for an inventive burner, for which the fuel was supplied to the burner distributed evenly to the sectors A and B. The measurement points indicated by squares 18 correspond to the carbon monoxide emissions occurring during operation of a conventional burner. In the present example the conventional burner involves a burner without the described sectors. Both the carbon monoxide emissions measured during the operation of the conventional burner and also those measured during even supply of fuel to the individual sectors of an inventive burner are well represented by curve 17.

Curves 15, 16, 17 are all characterized in that the carbon monoxide emissions occurring fall continuously as the flame temperature rises. However, for a specific flame temperature, the CO emission values of the curve 15 lie below the CO emission values of the curve 16 and below the CO emission values of the curve 17. The CO emission values of the curve 16 also lie below the CO emission values of the curve 17. The form of operation of an inventive burner represented in the curve 15 accordingly makes it possible to operate the burner at a lower flame temperature with simultaneously reduced carbon monoxide emissions compared to the burners or forms of operation represented by curves 16 and 17.

Overall the arrangement of the sectors A and B in an inventive burner 107 described in conjunction with FIGS. 3 and 4 thus represents a preferred embodiment of the invention, with advantageously in part-load operation at least 70% of the overall fuel supplied to the burner 107 being supplied to sectors B. In this preferred embodiment quench effects are reduced and a stable operation of the burner 107 is made possible at a relatively low flame temperature. At the same time, despite this low flame temperature, no additional or only an insignificantly greater amount of carbon monoxide is produced compared to full-load operation. If the nitric oxide emissions and the carbon monoxide emissions are to be minimized at the same time, it is advantageous for the sectors B to be supplied with between 70% and 80% of the fuel supplied to the burner 107. Overall, with the overall amount of fuel remaining the same and thereby with the output remaining the same, the carbon monoxide emissions are reduced.

The invention claimed is:

1. A method for operating a burner, comprising:

providing a burner outlet opening including at least two sectors;

assigning each sector a plurality of fuel nozzles; and supplying a fuel to a plurality of fuel nozzles of different sectors separately, wherein during a full load operation, essentially an even supply of the fuel is provided to all sectors to produce a homogenous temperature distribution, wherein during a part load operation, hotter and colder zones are created in a combustion chamber, with the hotter zones placed where the greatest quench effect would otherwise be expected, wherein the burner is one of a plurality of burners arranged circumferentially in a combustion chamber, about a central axis of the combustion chamber, wherein the burner has a radial direction and a tangential direction in relation to the central axis, and wherein a first plurality of fuel nozzles that are assigned to a first sector arranged along the tangential direction of the burner are supplied with less fuel at said part load than a second plurality of fuel nozzles that are assigned to a second sector arranged along the radial direction of the burner.

2. The method as claimed in claim 1, wherein the plurality of fuel nozzles of different sectors are supplied with the fuel in a ratio of between 0:100 and 100:0, said ratio being a fuel ratio between the fuel supplied to the at least two sectors.

3. The method as claimed in claim 2, wherein said ratio is between 0:100 and 35:65.

4. The method as claimed in claim 1, wherein the first plurality of fuel nozzles are supplied with 20% of an overall amount of fuel supplied to the burner, and wherein the second plurality of fuel nozzles are supplied with 80% of the overall amount of fuel supplied to the burner.

5. A burner, comprising:

a burner outlet opening including at least two sectors, each sector including a fuel nozzle;

at least two separate fuel supply lines leading to the plurality of fuel nozzles of different sectors; and a facility for setting a fuel mass flow flowing through the respective fuel supply line, wherein the facility includes a plurality of valves arranged in the respective fuel supply line that may be regulated, wherein the plurality of valves are separately controlled such that in full-load operation an even supply of fuel is provided to all sectors to produce a homogenous temperature distribution, wherein in a part-load operation hotter and colder zones are able to be created in the combustion chamber, a greatest quench effect occurs in the hotter zones, wherein the burner is one of a plurality of burners arranged circumferentially in a combustion chamber, about a central axis of the combustion chamber, wherein the burner has a radial direction and a tangential direction in relation to the central axis, wherein a first plurality of fuel nozzles are assigned to a first sector arranged along the tangential direction of the burner and a second plurality of second fuel nozzles are assigned to a second sector arranged along the radial direction of the burner, wherein the facility for setting the fuel mass flow is operable to regulate the valves arranged in the respective fuel supply lines such that the first plurality of fuel nozzles is supplied with less fuel than the second plurality of fuel nozzles at said part load.

6. The burner as claimed in claim 5, the burner outlet opening includes a circular cross-sectional surface.

7. The burner as claimed in claim 5, the plurality of fuel nozzles are arranged in a form of a ring in relation to a center point of the burner outlet opening.

8. The burner as claimed in claim 7, wherein the plurality of fuel nozzles lying opposite to one another in each case are assigned the same fuel supply line.

9. The burner as claimed in claim 5, wherein the plurality of different sectors represent a plurality of segments of a circle, each segment having an angle of between 70° and 110°.

10. The burner as claimed in claim 9, wherein the plurality of fuel nozzles of opposing circle segments are assigned the same fuel supply line.

11. The burner as claimed in claim 9, wherein the plurality of different sectors represent the plurality of segments of a circle, each segment has the angle of 90°.

12. The burner as claimed in claim 11, wherein the plurality of fuel nozzles of opposing circle segments are assigned the same fuel supply line.

13. A gas turbine, comprising:

a burner, the burner comprising:

a burner outlet opening including at least two sectors, each sector including a fuel nozzle;

at least two separate fuel supply lines leading to the plurality of fuel nozzles of different sectors; and a facility for setting a fuel mass flow flowing through the respective fuel supply line, wherein the facility includes a plurality of valves arranged in the respective fuel supply line that may be regulated, wherein the plurality of valves are separately controlled such that in full-load operation an even supply of fuel is provided to all sectors to produce a homogenous temperature distribution, wherein in a part-load operation hotter and colder zones are able to be created in the combustion chamber, a greatest quench effect occurs in the hotter zones, wherein the burner is one of a plurality of burners arranged circumferentially in a combustion chamber, about a central axis of the combustion chamber, wherein the burner has a radial direction and a tangential direction in relation to the central axis, wherein a first plurality of fuel nozzles are assigned to a first sector arranged along the tangential direction of the burner and a second plurality of second fuel nozzles are assigned to a second sector arranged along the radial direction of the burner, wherein the facility for setting the fuel mass flow is operable to regulate the valves arranged in the respective fuel supply lines such that the first plurality of fuel nozzles is supplied with less fuel than the second plurality of fuel nozzles at said part load.

14. The gas turbine as claimed in claim 13, wherein the burner outlet opening includes a circular cross-sectional surface.

15. The gas turbine as claimed in claim 13, wherein the plurality of fuel nozzles are arranged in a form of a ring in relation to a center point of the burner outlet opening.

16. The gas turbine as claimed in claim 15, wherein the plurality of fuel nozzles lying opposite to one another in each case are assigned the same fuel supply line.

17. The gas turbine as claimed in claim 13, wherein the plurality of different sectors represent a plurality of segments of a circle, each segment having an angle of between 70° and 110°.

18. The gas turbine as claimed in claim 17, wherein the plurality of fuel nozzles of opposing circle segments are assigned the same fuel supply line.

19. The gas turbine as claimed in claim 17, wherein the plurality of different sectors represent the plurality of segments of a circle, each segment has the angle of 90°.

20. The gas turbine as claimed in claim 19, wherein the plurality of fuel nozzles of opposing circle segments are assigned the same fuel supply line.

* * * * *